US007155812B1

(12) United States Patent
Peterson et al.

(10) Patent No.: US 7,155,812 B1
(45) Date of Patent: Jan. 2, 2007

(54) METHOD FOR PRODUCING A TUBE

(75) Inventors: Kenneth A. Peterson, Albuquerque, NM (US); Steven B. Rohde, Corrales, NM (US); Kent B. Pfeifer, Los Lunas, NM (US); Timothy S. Turner, Rio Rancho, NM (US)

(73) Assignee: Sandia Corporation, Albuquerque, NM (US)

( * ) Notice: Subject to any disclaimer, the term of this patent is extended or adjusted under 35 U.S.C. 154(b) by 324 days.

(21) Appl. No.: 10/655,466

(22) Filed: Sep. 4, 2003

Related U.S. Application Data

(60) Provisional application No. 60/408,801, filed on Sep. 5, 2002.

(51) Int. Cl.
*H01C 17/00* (2006.01)

(52) U.S. Cl. ..... 29/610.1; 29/825; 29/829; 29/832; 29/846; 250/286; 250/287; 436/153; 445/35; 445/46

(58) Field of Classification Search ..... 29/610.1, 29/825, 829, 832, 846; 250/286, 287; 436/153; 445/35, 46; 156/89.12, 89.16, 184, 187
See application file for complete search history.

(56) References Cited

U.S. PATENT DOCUMENTS

| | | | | |
|---|---|---|---|---|
| 3,755,891 | A | 9/1973 | Muckelroy et al. | |
| 4,390,784 | A | 6/1983 | Browning et al. | |
| 4,475,967 | A | 10/1984 | Kanai et al. | |
| 5,028,473 | A | 7/1991 | Vitriol et al. | |
| 5,280,175 | A | 1/1994 | Karl | |
| 5,814,262 | A * | 9/1998 | Ketcham et al. | 264/316 |
| 5,965,882 | A | 10/1999 | Megerle et al. | |
| 6,051,832 | A | 4/2000 | Bradshaw | |
| 6,369,383 | B1 * | 4/2002 | Cornish et al. | 250/286 |
| 6,527,890 | B1 | 3/2003 | Briscoe et al. | |
| 6,586,885 | B1 | 7/2003 | Coll et al. | |
| 6,607,414 | B1 | 8/2003 | Cornish et al. | |

OTHER PUBLICATIONS

Vita, Standard Glass Transfer Tapes, Aug. 1, 1974, 8 pgs., Product Data Sheet, Bethel, CT.
Dupont, DuPont Microcircuit Materials, Aug. 27, 2003, http://www.dupont.com/cmc/product/tapetbl,html.
Minco, Flex-Circuit Design Guide, Mar. 2000, 1-28, www.minco.com.
Steve Rohde and Ken Peterson, Applying New LTCC/Liga Construction Techniques . . . , Sep. 7, 2002, 28 vugraphs.

* cited by examiner

*Primary Examiner*—A. Dexter Tugbang
*Assistant Examiner*—Tim Phan
(74) *Attorney, Agent, or Firm*—William R. Conley; George H. Libman

(57) ABSTRACT

A method is described for producing tubular substrates having parallel spaced concentric rings of electrical conductors that can be used as the drift tube of an Ion Mobility Spectrometer (IMS). The invention comprises providing electrodes on the inside of a tube that are electrically connected to the outside of the tube through conductors that extend between adjacent plies of substrate that are combined to form the tube. Tubular substrates are formed from flexible polymeric printed wiring board materials, ceramic materials and material compositions of glass and ceramic, commonly known as Low Temperature Co-Fired Ceramic (LTCC). The adjacent plies are sealed together around the electrode.

12 Claims, 13 Drawing Sheets

METHOD FOR PRODUCING A TUBE

CROSS REFERENCE TO RELATED APPLICATIONS

This application claims the benefit of U.S. Provisional Application No. 60/408,801, filed on Sep. 5, 2002.

STATEMENT REGARDING FEDERALLY SPONSORED RESEARCH OR DEVELOPMENT

The United States Government has rights in this invention pursuant to Department of Energy Contract No. DE-AC04-94AL85000 with Sandia Corporation.

BACKGROUND OF THE INVENTION

This invention relates to tubular substrates having electrical conductors on an interior surface that are electrically connected through the tube wall to contacts on the tube exterior. Preferably, the conductors are concentric rings for a drift tube of an Ion Mobility Mass Spectrometer (IMS). This invention further relates to methods for producing such tubular substrates from flexible polymeric printed wiring board materials, ceramic materials and material compositions of glass and ceramic, commonly known as Low Temperature Co-Fired Ceramics (LTCC).

In the context of the present invention, LTCC is generally defined as a family of glass-ceramic dielectric substrate materials that are flexible and formable in the 'green' unfired state, and become rigid upon firing at temperatures below 1000° C. Such dielectric materials are widely used in the art and are supplied as flexible green sheets or tapes. Conductors, resistors, via fills, inductive and capacitive structures are incorporated in or printed on the LTCC dielectrics using compatible inks or pastes by processes well known in the art. These materials and recommended processing methods are well known and available commercially from Electro-Science Laboratories, INC, King of Prussia, Pa., the DuPont Company, Wilmington, Del. and Ferro Corporation of Cleveland, Ohio, among others.

An IMS is an analytical instrument that performs vapor phase compound speciation based on ion mobility in an atmospheric environment. Uses for an IMS include analyzing air samples for the presence of harmful substances in the form of toxic vapors, components of explosive materials, trace constituents of drugs, sampling of biological systems such as biogenic amines or fatty acid methyl esters, or other analytical chemistry applications. In a typical configuration, an IMS consists of a drift tube with drift gas inlet at one end, connected to an ionizing chamber at the opposed end, the ionizing chamber being provided with a sample gas inlet port. Gating grid electrodes are located between the drift tube and the ionizing region. An exhaust outlet for gases is provided for near the ionizing chamber and away from the gating electrodes. The drift gas, typically dry air, nitrogen or other inert gas, flows along the drift tube, past the sample inlet port, through the ionizing region and exits via the exhaust outlet. The sample to be analyzed is introduced along with a carrier gas, typically dry air, nitrogen or other inert gas, through the sample inlet port into the ionizing region where isotopic radiation, corona discharge sources, ultraviolet radiation or other known ionization techniques, ionize the constituents of the carrier and sample gases either by primary ionization of the analyte or secondary ionization by chemical reaction with a supplied dopant. Ions created in the ionizing region are attracted towards the entrance of the drift tube by the presence of an electric field. By applying a voltage pulse on gating grid electrodes separating the ionizing region from the drift tube, a controlled flow of ions is allowed into the drift tube, along which a generally linear potential gradient has been established. Ions within the drift tube are accelerated by the potential gradient and migrate against the drift gas flow, towards the ion detector. The rate or drift speed ($V_d$) at which ions migrate through the drift tube is controlled by their mobility (K) and the magnitude of the electric field (E) according to the following relationship $V_d$=KE. The ion's mobility is a generalized parameter that includes effects such as charge, collision cross-section, reduced mass of the ion-neutral collision pair, ion polarizability, temperature, and other variables. Chemical speciation is achieved by electronic circuits which monitor the ions collected on the detector, as a function of time passed since application of the voltage pulse to the gating electrodes. The resulting waveforms representing the number of ions collected versus time are well known to be indicative of the chemical species and their relative quantities, present within the gas sample being analyzed.

The construction of the drift tube, field and gating electrodes, ionizing region, gas inlet and exhaust port attachments, has significant impact in determining the size, cost, and performance of the IMS as a practical instrument. To achieve an optimized IMS, it is desired that the drift tube assembly be relatively small in size, airtight, constructed of non-contaminating materials, and of low cost to produce.

The following references teach several approaches for construction of the drift tube and it's associated components.

U.S. Pat. No. 4,390,784 to Browning et al discloses an ion accelerator for an ion mobility detector cell that is comprised of a ceramic tube coated inside with a thick film resistor composition across which a voltage potential difference is impressed to provide an ion accelerating electrical field gradient within the tube. One such tube is used to define the mobility detector reactant region and a second similar tube is used to define the drift region. Gating grid electrodes are provided by wire screens or mesh, contained in a separate mechanical assembly of many parts, placed inside the ceramic tube. This approach provides a functional system albeit one that is not amenable to miniaturization or low cost of manufacture.

U.S. Pat. No. 5,280,175 to Karl discloses a drift tube produced by stacking metal ring electrodes separated by insulating rings. The stack-up of conducting and insulating rings would be sealed with conventional o-rings, or brazed into an airtight assembly. To provide a voltage divider for creating a potential gradient along the drift tube, the ring electrodes would be interconnected with deposited or discrete resistor elements. The use of brazing to join the piece parts would produce a relatively inert, non-contaminating drift tube but requires a complicated assembly process.

U.S. Pat. No. 5,965,882 discloses a drift chamber created in the space between two printed wiring boards, separated by a Teflon™ spacer. Necessary electrodes are provided on the printed wiring boards and sealing of the drift chamber is accomplished by mechanical compression of the Teflon™ spacer. Systems constructed of such organic materials can be troubled with outgassing of contaminants from these materials, and may require extended flushing of the system to achieve optimum sensitivity.

U.S. Pat. No. 6,051,832 discloses a volume enclosure built up upon the surface of a printed wiring board by soldering a multiple of stamped metal assemblies onto it. A larger metal stamping is used to form the drift tube enclosure. Additional stampings are located within this volume and function as the electrode elements, interconnected by surface mounted discrete resistors. The joints within this structure are soldered to create an airtight enclosure. This system provides for integrating the electronics near the drift tube, but again requires a complex assembly process.

The applicants have described yet another approach to producing the drift tube assembly in the publication: "Applying New LTCC/LIGA Construction Techniques in Realizing a Miniature Ion Mobility Spectrometer", presented at the conference on Packaging of MEMS and Related Micro Integrated Nano Systems, sponsored by the International Microelectronics and Packaging Society, Sep. 7, 2002, Denver, Colo. This publication discloses an approach to miniaturizing an IMS by constructing a drift tube of alternately stacked sapphire insulators each having a centrally located hole, with thin metal plates each having a centrally located hole or screen feature to function as an electrode. In this approach, the many alternating layers of insulator and metal electrode plates are joined with adhesives or metallurgically bonded through brazing or soldering, to produce an airtight assembly. Machined blocks of ceramic or similar material are bonded at each end of the drift tube to provide inlet and exhaust gas ports and provide for the ionizing and reaction regions. Manufacture of such a device proved successful, but was labor intensive and prone to leakage, as is typical for a structure with a large number of joints, each required to be airtight. A need exists for a simpler method for producing a structure usable as the drift region of an IMS, that preferably would entail non-contaminating materials and minimize the number of airtight joints required.

It is desired to provide a method of forming tubular substrates beginning with readily available planar sheets of ceramic, glass-ceramic or suitable polymeric materials. The following references teach several approaches for forming three-dimensional structures in ceramic materials.

U.S. Pat. No. 3,755,891 to Muckelroy et al discloses a method for producing three-dimensional circuit modules utilizing thick-film manufacturing processes applied to the inner and outer surfaces of a provided substrate in the form of a ceramic cylinder. Circuit networks are printed on the inside and outside of the cylindrical substrate, utilizing screen printers having similarly shaped cylindrical screens. After firing of the circuit networks, interconnection is effected by conductive clips extending from conductors on the inner surface of the cylinder to conductors on the outer surface. While a method as taught by Muckelroy et al might provide a basis for developing a drift chamber, the requirement to print networks on the interior of a tube is difficult to manufacture, and necessarily restricts the process to tubular structures with a large inner diameter, to accommodate the screen printing means.

U.S. Pat. No. 4,475,967 to Kanai et al teaches a method for producing a ceramic capacitor by rolling a sheet of green ceramic material about a core. A conductor pattern of alternating electrodes, separated by insulating gaps, is printed on one surface of the green ceramic sheet. By eliminating the necessity to maintain accurate alignment of two green ceramic sheets, problems attributed to miss-alignment of the sheets could be avoided, such as increasing the scatter of capacitance values produced or short-circuits developing between the electrode patterns. Kanai et al does not provide a method for interconnecting inner and outer electrodes as these 'short-circuits' would be deleterious to producing a capacitor, and is cited as a disadvantageous by-product of processes requiring accurate alignment of two green ceramic sheets.

U.S. Pat. No. 5,028,473 to Vitriol et al discloses forming an electrical circuit pattern on a glass-ceramic thermally fusible tape. The tape is heated to a temperature at which it becomes temporarily plastic, and is then bent into a desired non-planar shape. A multi-layer structure can be provided by laminating together plural layers of LTCC tape with respective circuit patterns formed thereon, and plastically bending the laminated structure into the non-planar shape during a heating step. Interconnection of circuit patterns on different tape layers is by means of electrical vias formed through a tape layer. By this method, a circuit structure including a desired edge connector can be formed into a non-planar shape. Examples of bending glass-ceramic tape by heating the tape and shaping or pressing the softened tape about a mold form are provided. While this method can produce a shaped substrate, this method requires handling of glass-ceramic substrates heated to their softening point. Having to form the substrate while in the heated state unnecessarily complicates the process and exposes external conductor and resistor networks to potential damage during handling.

U.S. Pat. No. 6,527,890 to Briscoe et al teaches a method for producing a textured channel in a plurality of green-sheet layers, which are then sintered together to form a substantially monolithic structure. Such a channel, filled with a porous phase for differentially adsorbing chemical components, can be used as the column for separation of gas species by gas chromatography. While this method can produce a channel in a planar substrate, ionizing of species and control of ion flow through appropriate application of an electric field gradient is not required for separation of gas species in Briscoe's disclosed method, and thus there is no provision for producing such.

Each of the above references describes an approach having unique qualities, but no reference on it's own satisfies all of the required characteristics. There remains a need in the art for a more advanced and efficient method of producing a tubular structure with the necessary electrode elements, as can be utilized as a drift tube in an IMS. It is therefore an object of this invention to provide a drift tube that is relatively small in size, airtight, constructed of non-contaminating materials, and of low cost to produce.

BRIEF SUMMARY OF THE INVENTION

It is an object of this invention to provide a tubular substrate with electrodes on an internal surface that are electrically connected to the outer surface without the use of vias through the substrate.

To achieve the foregoing and other objects, and in accordance with the purpose of the present invention, as embodied and broadly described herein, the present invention comprises a tube formed from a rolled flexible substrate and having an interior, a lapped portion, and an exterior, the flexible substrate comprising a first surface and an opposed second surface extending from an interior end connecting the surfaces to an opposed exterior end. A second elongated electrode is affixed to the second surface and extends from the tube interior to the lapped portion; and a first elongated electrode is in direct electrical contact with the second elongated electrode at the lapped portion and extends along the first surface to the exterior of the tube. The substrate is preferably LTCC and the device is made by rolling a green substrate around a form for more than one revolution, restraining the rolled green substrate sheet on the form, applying a lamination pressure to set the green substrate to the form; and firing the rolled substrate sheet. The electrodes spiral through the wall of the tube from the tube interior to the tube exterior.

These and other objects of the present invention will become more fully apparent with reference to the following description and drawings, which relate to several preferred embodiments of the present invention.

BRIEF DESCRIPTION OF THE DRAWINGS

The accompanying drawings, which are incorporated in and form part of the specification, illustrate several embodiments of the present invention and, together with the description, serve to explain the principles of the invention.

DETAILED DESCRIPTION OF THE INVENTION

Figure 1:
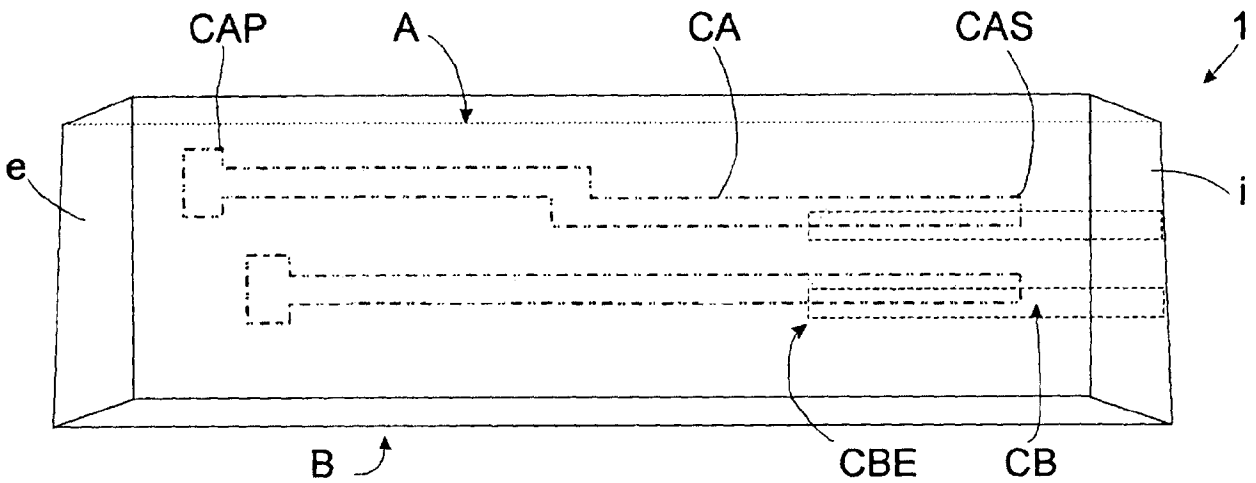
FIG. 1 shows first and second surfaces of a green ceramic sheet with conductor patterns.

In accordance with a first embodiment of this invention, FIG. 1 shows a flexible substrate (1) having opposed surfaces (A) and (B) and opposed ends (i) and (e). As discussed hereinafter, flexible substrate (1) may have conductors (CA) and (CB) on the opposing surfaces. Although shown as one layer, flexible substrate (1) may be formed of multiple layers each of which may contain one of the electrodes (CA) and (CB). As shown in FIG. 2*a*, substrate (1) is intended to be formed into a tube (7) having an axis (5) which may be perpendicular to a line (not shown) extending between ends (i) and (e). As is well known in the art, tube (7) may be formed by coiling or rolling surface (B) and end (i) of substrate (1) around a mandrel (9) that may be subsequently removed. For simplicity, FIG. 2*a* shows tube (7) to be formed from about one and one sixth revolutions of substrate (1) around mandrel (9). The invention contemplates tube (7) being formed from multiple revolutions of substrate (1). It should be understood that substrate 1 is drawn as being loosely wrapped around mandrel 9 only because it is difficult to distinguish conductor CA from CB if they are illustrated tightly connected to one another. As discussed below, no gaps are intended to be between adjacent layers in this device.

It is useful to define some terms relative to tube (7). The 'interior' of tube (7) is the portion of surface (B) extending from interior end (i) for one revolution. The 'lapped' portion of tube (7) begins at end (i) and includes all portions of substrate (1) where surface (B) overlaps surface (A). The 'exterior' of tube (7) is that portion of surface (A) that is not covered by surface (B).

An object of this invention is to have an electrode on the interior of tube (7) that extends to the exterior of tube (7). This object may be accomplished by having an electrode spiral along the surface of substrate (1), as shown in FIG. 2*a*. As shown herein, the resulting structure can be made impervious to the passage of gas through the side of tube 7.

An internal electrode in the form of a ring is formed if a straight electrode (CB) extends around the interior of tube (7) perpendicular to axis (5) and if the length of electrode (CB) is greater than the circumference of mandrel (9) (which defines the internal circumference of tube (7).

As shown in FIG. 2*a*, one embodiment for connecting this internal electrode (CB) to the outside of tube (7) is to provide a second elongated electrode (CA) on surface (A) that extends from a start location (CAS) in the lapped portion of tube (7) to a pad (CAP) on the tube exterior. Start location (CAS) must be located on surface (A) such that it will overlay and contact at least a portion of electrode (CB). If electrode (CB) is perpendicular to axis (5), electrode (CA) is preferably also perpendicular to axis (5) and directly opposite electrode (CB). As illustrated in FIG. 2*a*, start location (CAS) is adjacent and contacts end (CBE) when substrate (1) wraps around mandrel (9). Pad (CAP) is placed at a location on substrate (1) where it will be on the exterior of tube (7).

Figure 2B:
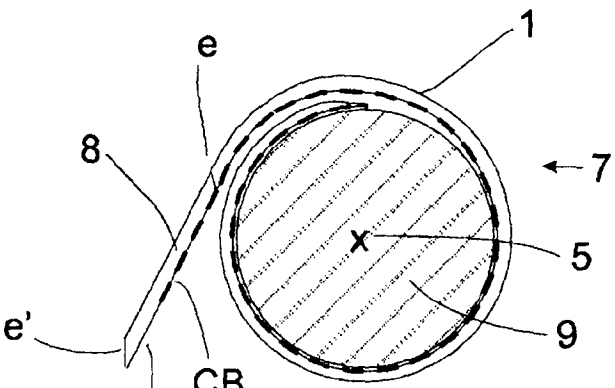
FIG. 2*b* shows a cross section of a second embodiment of a tube using the sheet of FIG. 1.
Figure 2A:
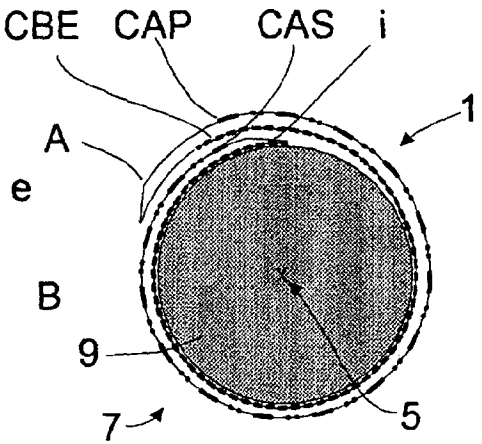
FIG. 2*a* shows a cross section of a first embodiment of a tube using the sheet of FIG. 1.

An alternate embodiment for connecting electrode (CB) to the outside of tube (7) is illustrated in FIG. 2*b*. As shown end (e) may be extended to (e') to form a 'tail' (8) which is accessible to both surfaces. In this event, no electrode (CA) is needed, as electrode (CB) may continue for a sufficient length beyond end (e) to a location outside tube (7).

Although a tube (7) would most easily be formed by rolling a rectangular substrate around an axis (5) that lies perpendicular to one side of the rectangle, the invention may still be utilized if the axis (5) lies an acute angle to one side of the substrate. In that instance, the tube would extend along axis (5) with each revolution, but the electrodes may still be placed in accordance with the teaching herein. If the substrate is not of uniform width, the resulting tube will not be of uniform thickness, which may be desirable in some applications. Furthermore, there is no requirement that electrode CA follow the shortest possible path to the exterior of the tube. It could even be directed to the side of the substrate (the end of the tube), and be accessible if the substrate were cut so that no additional turns were placed above the electrode at the tube end. Such modifications will be apparent to those of ordinary skill in the art.

There are many known techniques for forming the flexible substrate into a coil or spiral as discussed above. For example, end (i) could be held against the mandrel while the mandrel is rotated at a fixed location. Also, the mandrel could be rolled along a flat surface holding the substrate. Or the substrate could be wrapped around the mandrel. The tube is most frequently described herein as being 'rolled', and it is intended that in this context, 'roll' means these and other known techniques for forming a substrate into a tube.

As shown in FIG. 1, it is preferred that when the flexible substrate comprises a green ceramic or glass-ceramic material, the ends of the substrate (i) and (e), are beveled in the manner shown. The beveled edges result in a smoother exterior surface profile in the overlapped region of the rolled and fired tube, and reduce the tendency for the formation of cracks or defects in the vicinity of an otherwise un-beveled edge. The beveling step can be performed by cutting ceramic or glass-ceramic substrate at an angle with a sharp tool or by drawing the edge of the substrate across an abrasive surface, such as sand paper, at an angle equal to the desired bevel angle. In the preferred embodiment, an included angle of approximately 30 degrees was used but any practical bevel angle would be effective.

In the preferred embodiment of the invention, a flexible substrate comprising one sheet of green LTCC tape, DuPont Type 951-AX Green Tape™, was used to produce a rolled tube. A flexible substrate thickness of about 0.010' was used in this embodiment but thicker and thinner flexible substrates, or a multi-layer flexible substrate could be used as well. Illustrated in FIG. 3*a*, a plurality of elongated conductors ($CA_1$ through $CA_n$) were printed on surface (A) of sheet (1) to form exterior electrodes on the tube, and as shown in FIG. 3*b*, a like plurality of elongated conductors ($CB_1$ through $CB_n$) were printed on the opposed surface (B) of green sheet (1) in a pattern to provide interior electrodes on the tube. Conductors ($CA_1$ through $CA_n$) are aligned in such a manner that each individual conductor will contact each corresponding conductor ($CB_1$ through $CB_n$) in the overlap portion (12) of the tube. In the overlapping portion (12), the exterior surface (A) of sheet (1) is in direct contact with the interior surface (B) of sheet (1) and upon firing the LTCC, the two surfaces will fuse to effect an airtight seal of the rolled tube. It is an object of this invention that the conductors on the exterior of the eventual tube provide electrical access to the conductors on the interior of the eventual tube, and additionally provide a means for electrically interfacing to electronics, such as that used to control an IMS.

It is preferred to take advantage of the fine line width and spacing capability of commercially available screen printer and micro-pen methods for forming the conductors. The width and spacing of the conductors is not critical to the invention, however a greater number of parallel spaced concentric conductor rings on the interior of a drift tube is preferred, as this will provide a more uniform electric field along the drift tube's length. In the present embodiment, 0.020' wide gold conductors were printed with 0.010' spacings on 0.030' centers by well know screen printing processes using conductor materials compatible with DuPont 951 Green Tape™. In another embodiment of the invention, conductors as narrow as 0.004' wide and spacings as fine as 0.004' were produced on a flexible substrate by a well known micro-pen method.

Figure 3A:
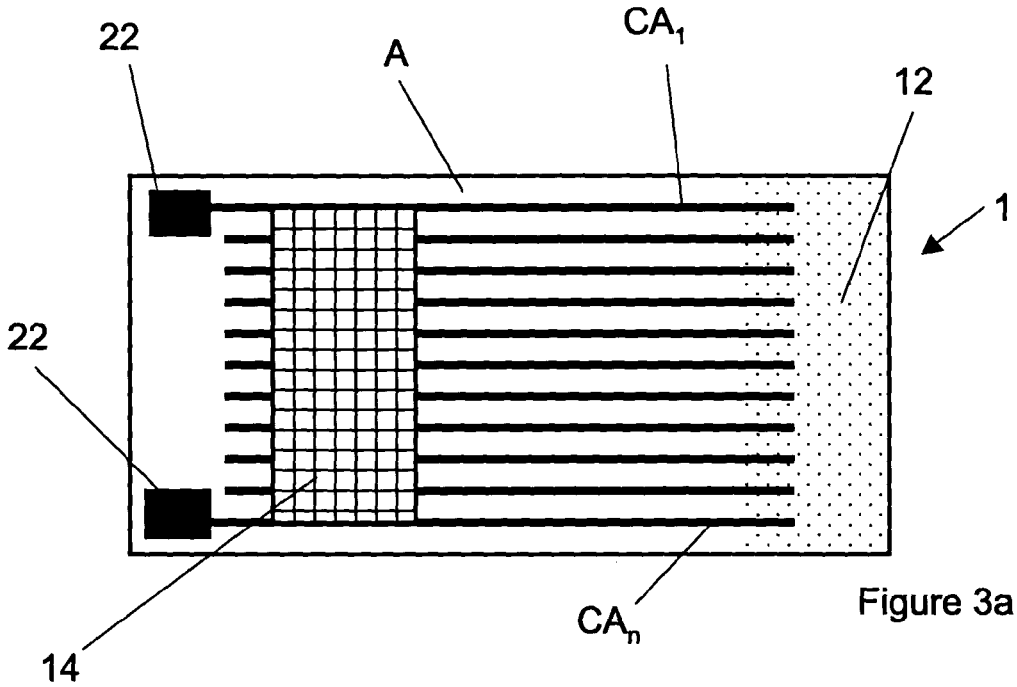
FIGS. 3*a* and 3*b* show, respectively, opposite sides of a green sheet for use in making a drift tube.
Figure 3B:
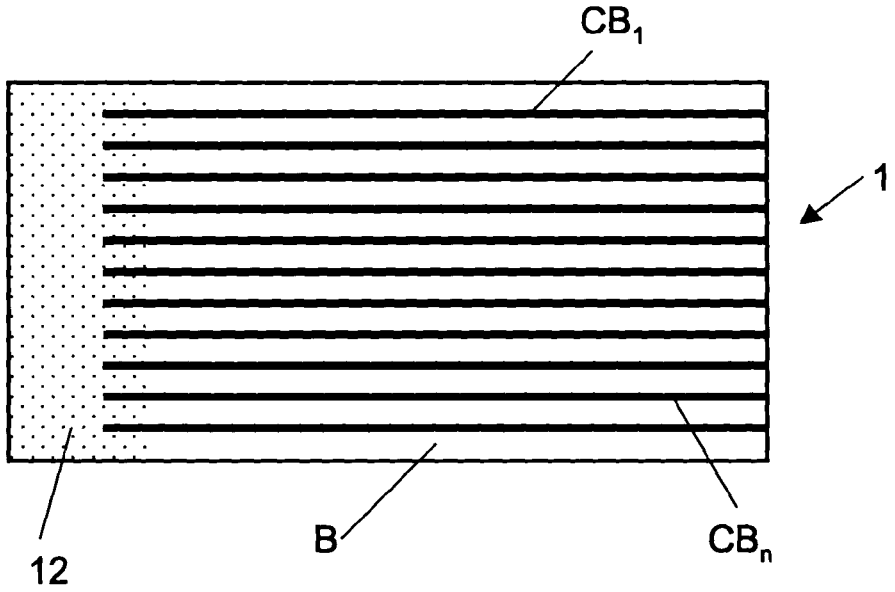

As shown in FIG. 3*a*, a resistor (14) was applied by conventional screen printing methods to flexible substrate (1), to electrically interconnect the conductors ($CA_1$ through $CA_n$), and form a voltage divider network, accessible by means of contact pads (22) on the exterior surface of the eventual tube.

After conductor and resistor patterns are applied to the flexible substrate, the substrate is rolled around a mandrel as shown in FIG. 2*a*, overlapping each interiorly printed conductor ($CB_1$ through $CB_n$) with corresponding conductor ($CA_1$ through $CA_n$) printed on the exterior surface of the now formed tube (7). In practice it has been found that during the rolling step, maintaining proper alignment of the interior (CB) and exterior conductors (CA), to ensure contact in the overlap region, can be readily accomplished manually.

Figure 4A:
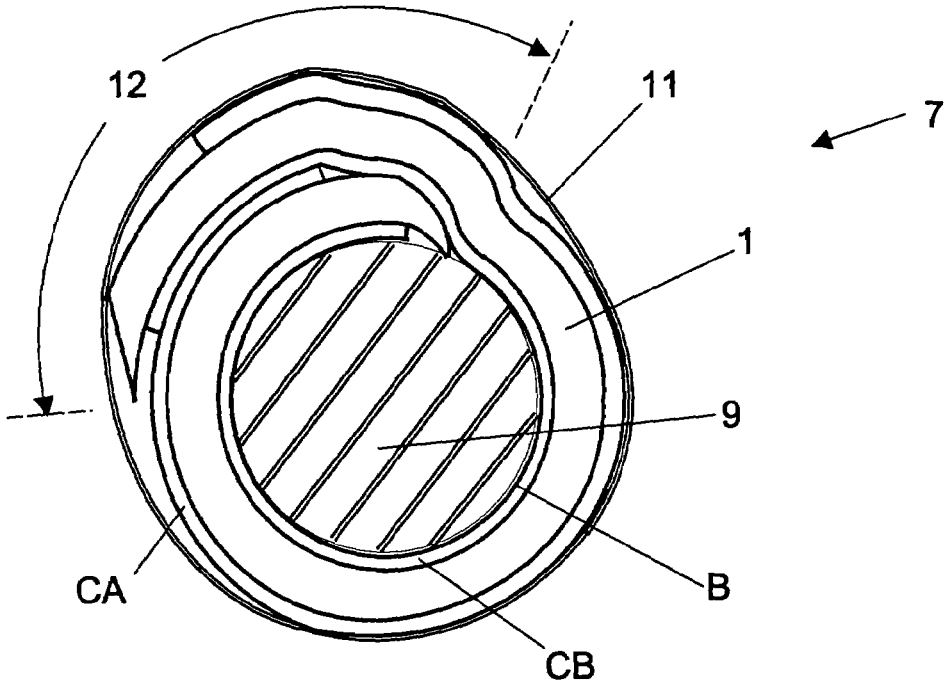
FIG. 4*a* shows the tube of FIG. 2*a* restrained during the manufacturing process.

The rolled flexible substrate (1) is restrained on the mandrel by tightly wrapping the tube with a suitable polymer film (11) shown in FIG. 4*a*. It is preferred to perform the restraining step with a flexible polymer comprising polyvinyldine chloride, commonly known as Saran Wrap™. Isostatic lamination conditions of about 3000 psi at about 68° C. and for about 15 minutes were applied to the restrained LTCC substrate while on the mandrel, to conform the interior surface (B) of the tube (7) to the mandrel (9) and set the overlapped areas of the sheet. Setting refers to the process where in an overlapping region, a surface of a green ceramic sheet is mechanically bonded or fused, to another surface of a green ceramic sheet. In the present embodiment a mandrel (9) with a round cross-section is used but similarly a mandrel with square, hexagonal or other cross sections could be used. After the lamination step the mandrel is normally removed and the formed green ceramic tube (7) is stood on end and fired, in a conventional box oven or belt furnace. Alternatively if desired, the mandrel (9) could be left in the tube (7) during firing.

Co-firing, sintering or firing of the green ceramic are synonymous terms, where co-firing is commonly used to indicate the simultaneous firing of a green LTCC substrate with conductors, resistors, vias or other structures formed from compatible materials. For a typical firing profile, the green LTCC is first brought from room temperature, approximately 22° C., to 450° C. at a 3° C./minute thermal ramp rate. It is held at 450° C. for 2 hours and is then brought to 850° C. at a 2° C./minute ramp rate, and held at 850° C. for about 30 minutes and allowed to cool back to room temperature. At 450° C. organic material within the tape burns off. Had the tape been brought directly to 850° C., these organics would have formed carbonates, which degrade most of the LTCC's properties. Thus it is important that the firing profile allow sufficient time at 450° C. to completely burn off the organic materials within the tape. At 850° C., lower melting glass constituents within the LTCC soften and fuse the higher melting ceramic constituents into a dense body.

Figure 4B:
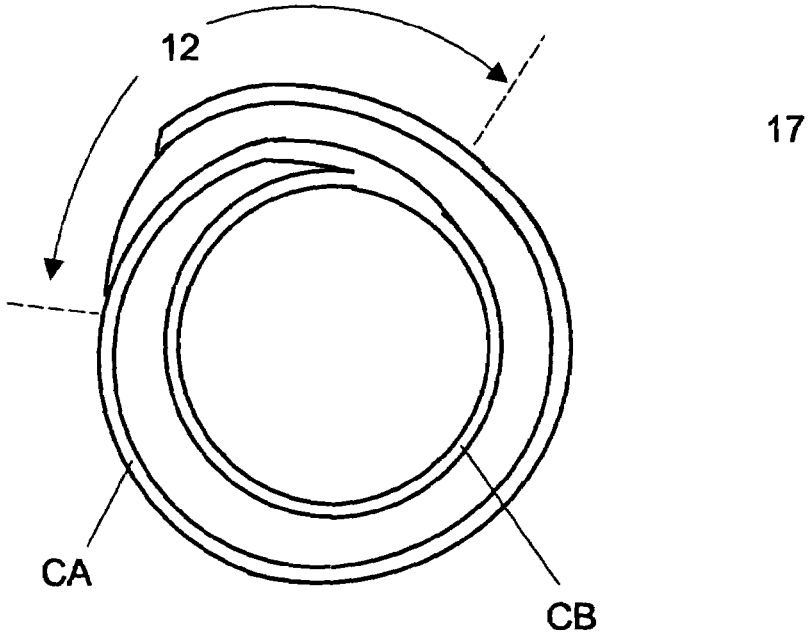
FIG. 4*b* shows a cross section of the tube of FIG. 2*a* after firing.

FIG. 4*b* shows a cross-section of a laminated and fired LTCC tube (17) where conductors ($CB_1$ through $CB_n$) form parallel spaced concentric rings on the interior of the tube. Each ring is electrically contacted to an exterior conductor ($CA_1$ through $CA_n$) by that portion of conductor CA which spirals through the body of the tube in the overlapping region (12). Since the individual layers of the green substrate are merged into one structure by the process, the conductors on the interior surface of a formed tube are clearly physically and electrically contacted to the conductors on the exterior surface of the tube by a process that does not require vias in the ceramic sheet. It is preferred to avoid the use of vias in the wall of the tube, as vias can lead to the formation of leakage paths that could impair the desired airtight quality of a drift tube. The length of the overlapped region (12) is not critical to the invention and can be adjusted as needed. For obtaining a reasonable mechanical strength in the fired tube while minimizing material requirements, it has been found that about two and one half complete wraps of the 0.010' flexible LTCC substrate is preferable. More wraps of flexible LTCC can be used to build up the wall thickness of the tube for higher strength as might be needed to accommodate high pressure or vacuum applications. In the other extreme, the area of overlap may be reduced to zero resulting in a butt style joint in the sheet along the length of the ceramic tube.

It has been found that high quality, high aspect ratio tubes can be produced by this method without slumping of the green LTCC tube during the firing step. By this method, fired tubes having and inner diameter of from 0.238' to 0.500 and from 1.5' to 5.0' in length have been produced with wall thicknesses from 0.020' to 0.040'. These dimensions are not seen as limitations of the process, only exemplary of what has been done. After the firing step, the now sintered ceramic tube is trimmed to the desired length.

As shown in FIG. 3*a*, resistors (14), preferably on the exterior of the tube, are incorporated with the conductors ($CA_1$ through $CA_n$) to form a voltage divider network The resistors may be formed by screen printing or micro-pen methods on flexible LTCC substrates prior to lamination and co-fired, or alternatively may be printed on the exterior of the fired tube and subsequently post-fired. To achieve high precision tolerances of the individual resistor values, an active trimming step, preferably with a laser, is used to individually adjust the value of each resistor in the voltage divider network. As shown in FIG. 3*a*, an individual resistor is formed between each of subsequent conductor pairs, for example between ($CA_1$ and $CA_2$) through ($CA_{(n-1)}$ and $CA_n$). As practiced in active trimming, an external circuit is used to monitor the resistance of each individual resistor as a laser ablates material, normally in the form of a notch extending inward from one edge of the resistor. In this manner, the resistance of each individual resistor is trimmed up to a desired value with great precision. For simplicity, the resistor (14) is shown as a continuous printed strip, on top of and crossing over the previously printed conductors ($CA_1$ through $CA_n$). In practice, it is preferred to not print resistor (14) as a continuous strip, but to provide gaps in the resistor strip centered over each individual conductor that the resistor crosses over, to facilitate the burning out of organic materials from the printed resistor during firing.

Figure 5:
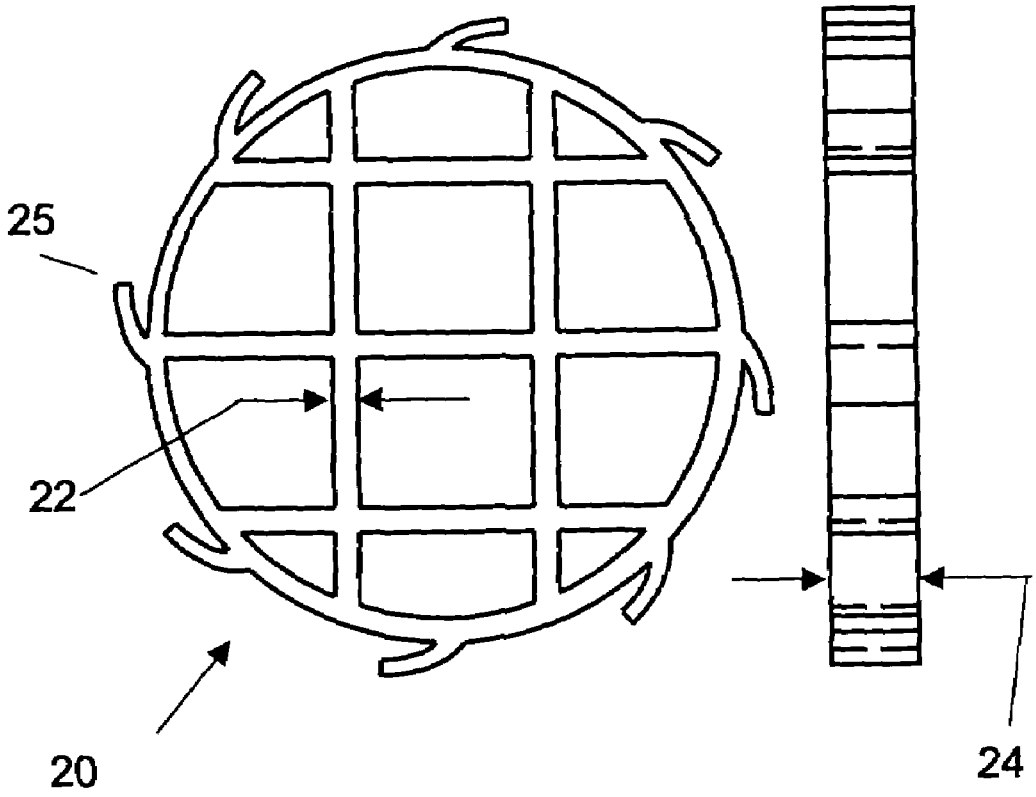
FIG. 5 shows plan and side views of an electrode for use in the drift tube of the invention.

Electrodes and gating grids for the drift tube can be provided by methods such as conventional wire mesh, mechanical stamping or photo-lithography of metal sheets, or LIGA (a German acronym that stands for Lithographic Galvonoformung Abformung, or the English translation, lithography, electroplating and molding). An excellent reference on LIGA processing is provided in: Chapter 18, "X-Ray-Based Fabrication" of 'The MEMS Handbook', CRC Press 2002. FIG. 5 is an illustration of front and side views of an electrode (20) as produced by the LIGA process. In the present embodiment of the invention, nickel and nickel-iron alloy electrodes were produced by the LIGA process with a web width (22) of 10 microns and web depth (24) of 150 microns to achieve an aspect ratio of 15:1. It is preferred to have spring structures (25) around the perimeter of the formed electrode to provide electrical contact to conductor rings on the interior of the tube, while providing a means for mechanically securing the electrode in place. Suitably formed electrodes are inserted into the bore of the tube with the aid of an insertion tool, that slightly compresses the spring structures and assures alignment with an appropriate internal conductor ring. The electrodes may be glued, soldered, brazed or held in place by simple mechanical pressure or confinement. It is preferable to use electrode screens produced by the LIGA process as the high web depth to web width aspect ratio results in a more rigid structure than is provided by the use of fine gauge wire mesh or thin photo-etched sheets. The mechanical stiffness of electrodes produced by the LIGA process minimizes their susceptibility to generation of electrical noise within the IMS electronics, due to vibrations of the electrode as may occur during handling or movement of the instrument. An additional benefit to electrode grids produced by LIGA is that a small web width, on the order of 10 microns, minimizes the effective cross-sectional area of the electrode that could act to block the flow of gas and ions through the drift tube.

Figure 6:
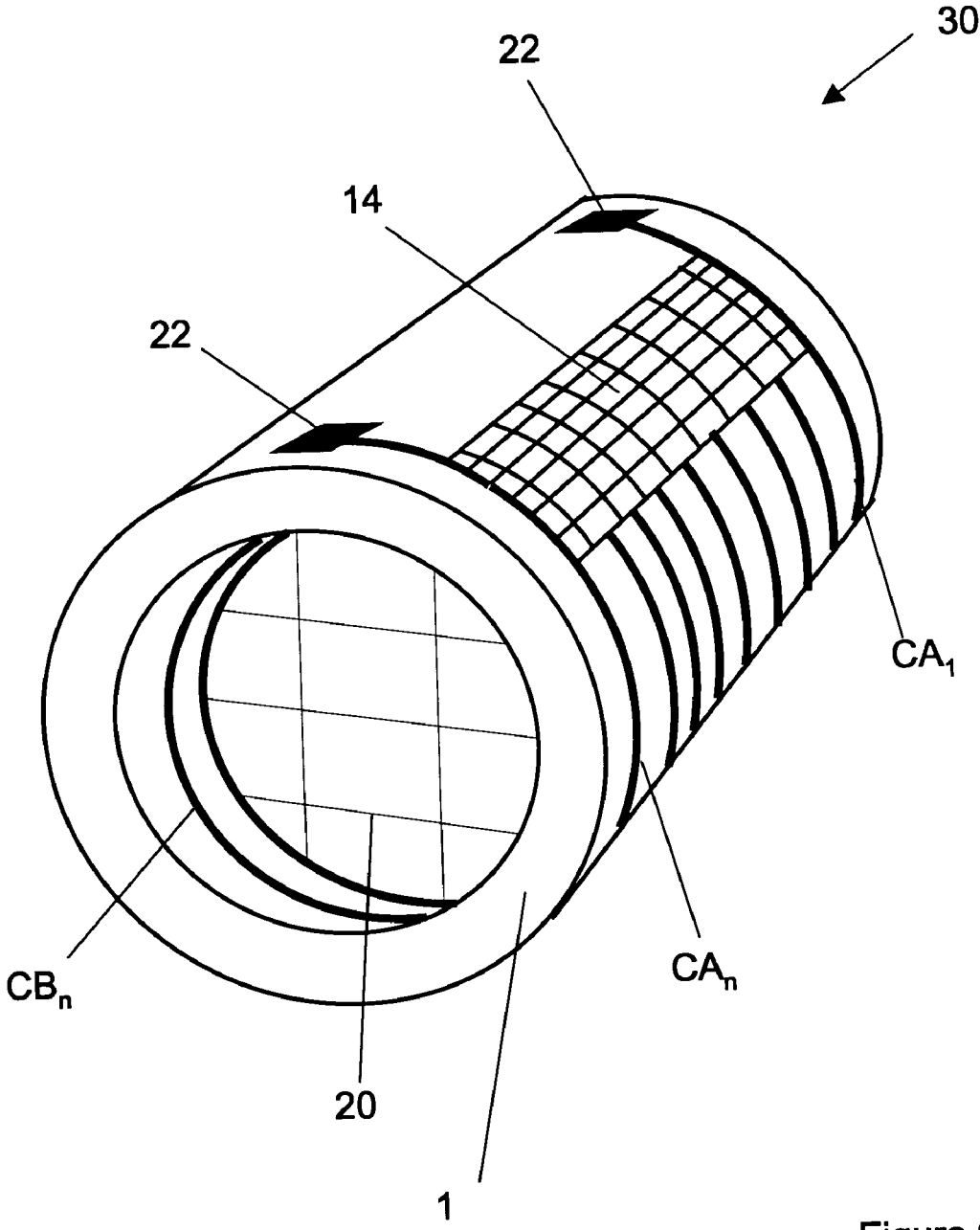
FIG. 6 shows an embodiment of a drift tube containing the electrode of FIG. 5.

An embodiment a drift tube produced by this method is shown in FIG. 6. The drift tube (30) is comprised of a rolled and fired LTCC substrate (1) having parallel spaced concentric conductor rings ($CB_1$ through $CB_n$) on the interior surface of the tube, electrically accessible by exterior conductors ($CA_1$ through $CA_n$). A resistor (14) in combination with the exterior conductors ($CA_1$ through $CA_n$) forms a voltage divider network that upon application of a voltage potential across contact pads (22) will establish a uniform electric field gradient along the length of the tube. Contact pads (22) provide interfacing the drift tube to the electronics of an IMS (not shown). Internal electrode grids produced by the LIGA process (20) are inserted in the interior of the tube, contacting an appropriate internal conductor ring.

The now essentially complete drift tube may be joined to an end cap structure to provide for carrier gas flow into the drift tube, a sample gas inlet structure and an ionizing source which additionally provides an exhaust port for gases to exit the instrument. These structures are simple mechanical structures well known in the art and may be produced by machining of traditional ceramics, firing of LTCC or other materials. The drift tube is mechanically attached to these components by traditional adhesive or metallurgical methods.

In another embodiment of the invention, a plurality of flexible green LTCC tape layers are provided with a through hole and are stacked to form a planar substrate with the through holes defining a tube extending through the stack. Alternate tape layers in the stack are provided with a conductor surrounding the through hole to form parallel spaced conductor rings on the interior surface of the tube. By this method multi-layer stacks of green LTCC sheets are fired to produce sub-sections of an eventual drift tube.

Figure 7A:
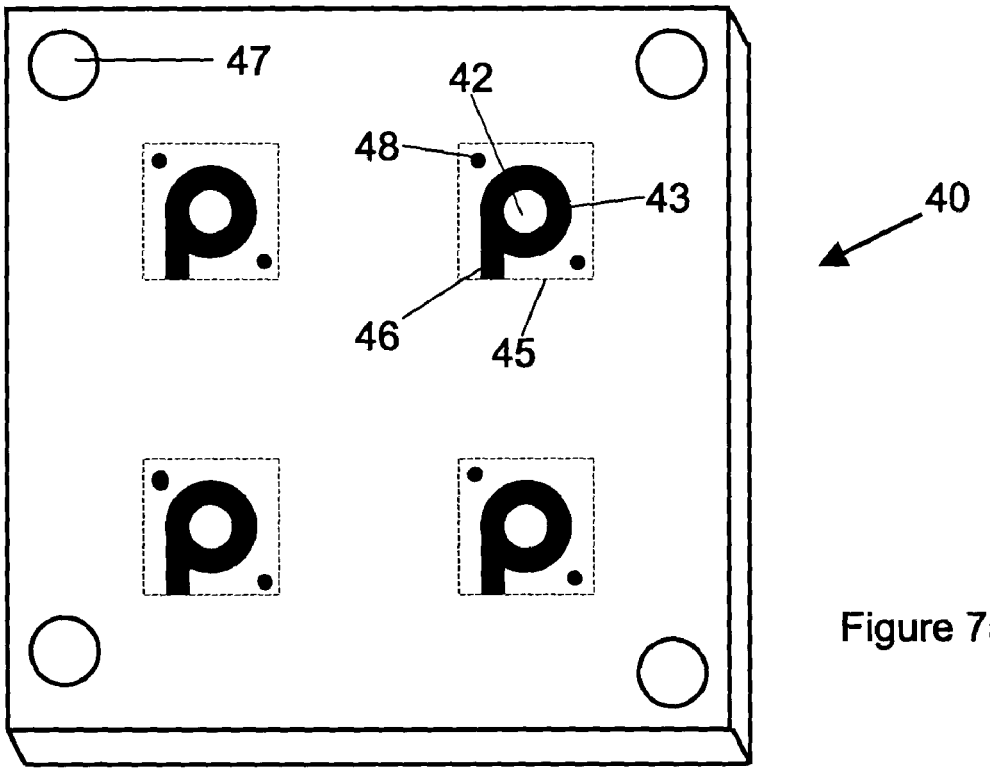
FIGS. 7*a* and 7*b* show alternate layers of green sheets forming a second embodiment of the invention.
Figure 7B:
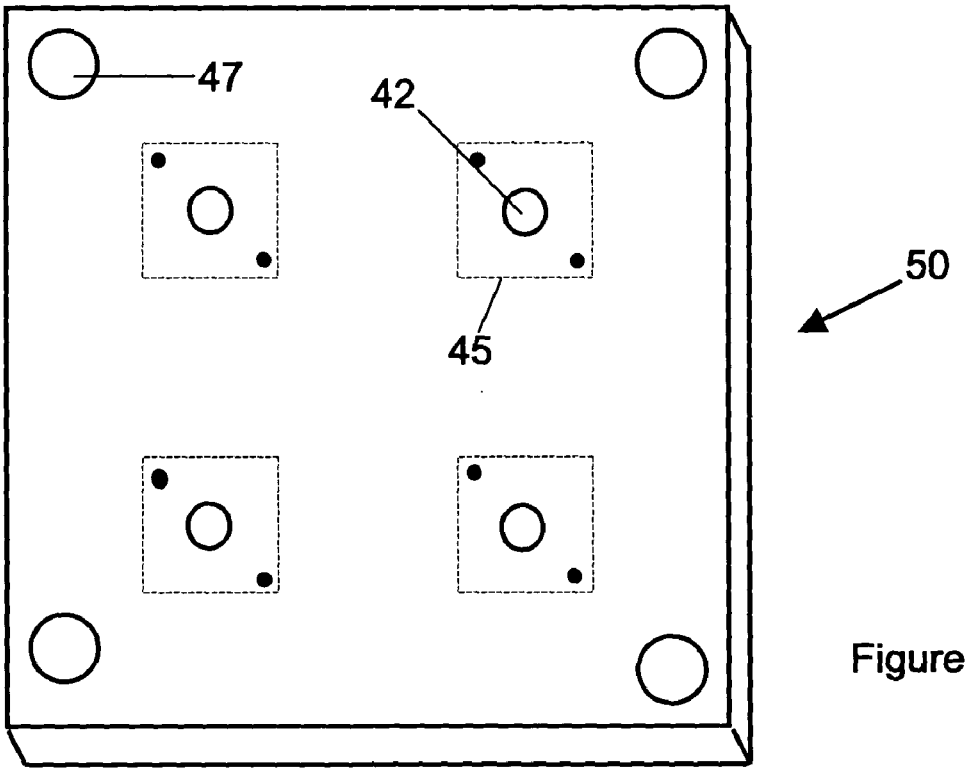

In this embodiment as shown in FIG. 7*a*, a first flexible green LTCC sheet (40) approximately 0.010' thick, was provided with four through holes (42), and four gold conductors (43) formed by screen printing, to produce four individual sub-sections of an eventual tube, the extents of each individual sub-section being indicated by dashed lines (45). Four sub-sections of a tube are formed in a single stack up of a plurality of LTCC sheets and later separated from the fired stack up by sawing, along dashed lines (45). Each conductor (43) is printed up to the edge of through hole (42) and is preferably continuous about the perimeter of the hole (42). The conductor pattern also is provided with an extension (46) outward from the edge of through hole (42) to the outer extent of each individual sub-section, indicated by dashed lines (45). Alignment holes (47) are additionally provided in each of the green LTCC sheets, to allow for inserting pins (not shown) through the stack up of sheets, to provide layer to layer alignment of through holes (42). As shown in FIG. 7*b*, a second flexible green sheet of LTCC not having conductors (50) is provided with through holes (42) and alignment holes (47) such that when a sheet (50) is placed upon a sheet (40), through holes (42) in sheet (50) are aligned with through holes in sheet (40), by means of inserting alignment pins extending through the alignment holes (47) in each sheet.

Figure 8:
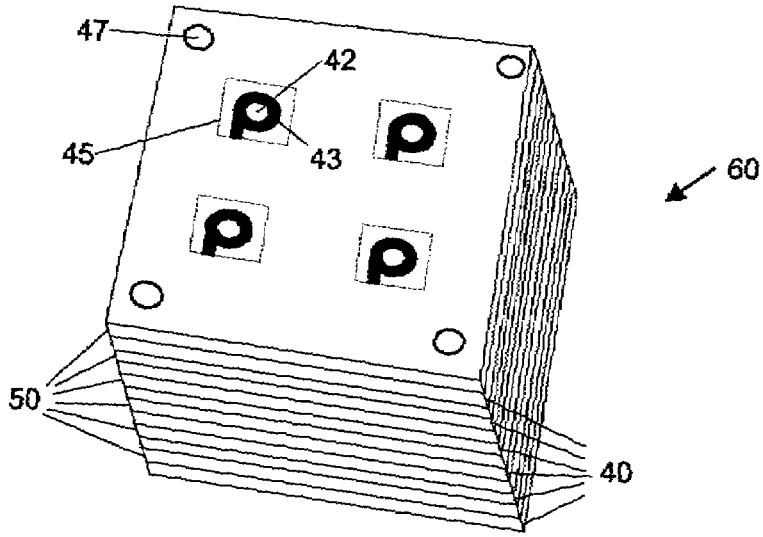
FIG. 8 illustrates a stack of the green sheets of FIGS. 7*a* and 7*b*.

In the present embodiment, 25 green LTCC sheets (40) according to FIG. 7*a* were alternately stacked with 25 green LTCC sheets (50) according to FIG. 7*b*, to form the multi-layer stack up (60) as shown in FIG. 8. For simplicity, only 12 sheet layers are shown in FIG. 8. Alignment of the through holes (42) was maintained by placing alignment pins (not shown) through the alignment holes (47) in the stacked sheets as is commonly practiced in the art. The aligned stack up of green sheets was then laminated using typical isostatic lamination conditions of about 3000 psi at about 68° C. for about 15 minutes. After lamination the multi-layer stack-up is fired in a conventional box oven or belt furnace to produce a fired ceramic substrate. For a typical firing profile, the tape is first brought from room temperature, approximately 22° C. to 450° C. at a 3° C./minute thermal ramp rate. It is held at 450° C. for about 2 hours and is then brought to 850° C. at a 2° C./minute ramp rate, and held at 850° C. for about 30 minutes.

Figure 9:
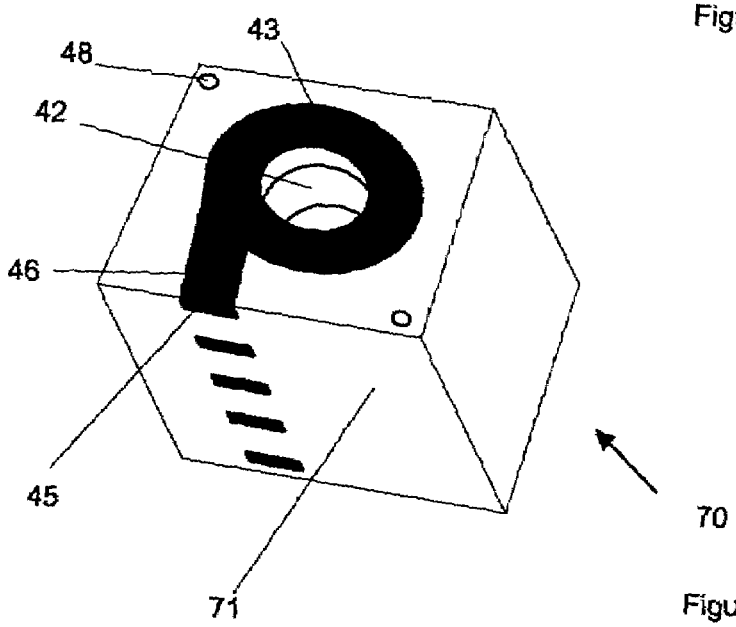
FIG. 9 illustrates a tube sub-section cut from the fired stack of FIG. 8.

After firing the individual sub-sections are separated from the substrate by sawing along the dashed lines shown in FIG. 8. FIG. 9 shows an individual sub-section (70) after the sawing step. In the present embodiment sub-sections (70) were produced being approximately 0.394' square and 0.394' thick, having a centrally located 'tube' of approximately 0.236' inner diameter. These dimensions are merely exemplary of the invention and can be varied as desired for a particular application. As shown in FIG. 9, the outer end (45) of the extension (46) of conductor (43) on each printed layer is exposed on outer surface (71) of the sub-section (70) by the sawing process. For illustrative purposes, only five of the twenty five conductor ends (45) in the present embodiment are shown in FIG. 9. After sawing the individual sub-sections from the fired substrate, the inner diameter of the tube formed by alignment of holes (42) and the exterior surfaces (71) of the sub-section may be ground or polished by conventional means to provide smoother surfaces as preferred for a drift tube. Conductor (43) is exposed on the inner diameter of hole (42) by the grinding process. The exposed conductors (43) form parallel spaced conductive rings on the inner diameter of the formed tube that are electrically accessible on an exterior surface (45) as required to apply an electrical field gradient along the length of the eventual drift tube. In the present embodiment of the invention, by printing conductor patterns (43) on alternate tape layers the parallel conductor rings are spaced approximately every 0.017' along the length of the eventual drift tube. It is an advantage of this method to achieve a large number of parallel spaced conductive rings on the inner diameter of the eventual drift tube, to allow for providing a very uniform electrical field gradient along the length of the tube.

Figure 10:
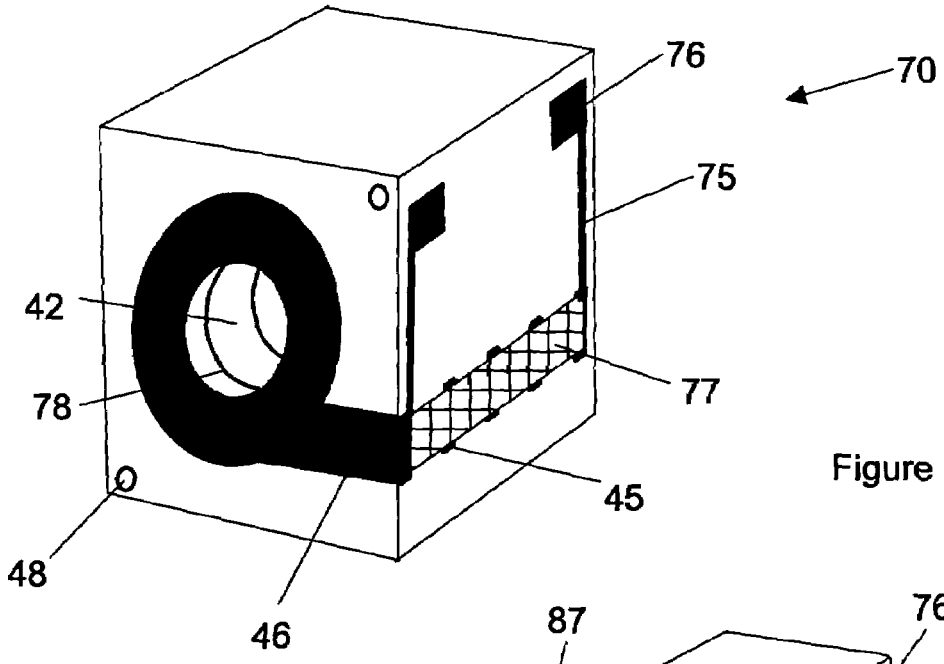
FIG. 10 illustrates the tube sub-section of FIG. 9 with post-fired resistors and conductors applied.

FIG. 10 shows post-fired conductor (75) and post-fired resistor (77) patterns applied to external surface (71) of sub-section (70). Resistor pattern (77) serves to interconnect the parallel spaced conductor rings (78) on the inner diameter of the hole (42), by contacting conductor ends (45), forming a voltage divider network with contact pads (76) for interfacing to external electronics, as may be used in an IMS. To achieve a tube of extended length, multiple sub-sections (70) are aligned and joined together by inserting pins through alignment holes (48), and bonding sub-sections using adhesive, metallurgical or fusible glass means. In the present embodiment, a fusible glass was used in bonding sub-sections to provide a simple assembly process, while avoiding the use of organic adhesives. Fusible glasses are available commercially in many forms, such as Vitta Corporation's, composition G-1005 transfer tape, as used in the present embodiment of the invention. It is preferred to use a fusible tape composition that is closely matched to the thermal expansion coefficient of the drift tube material (LTCC). The fusible tape is provided in sheet form and is cut to the dimension of the sections to be bonded and is punched or cut to allow unobstructed clearance of the through holes (42).

Figure 11:
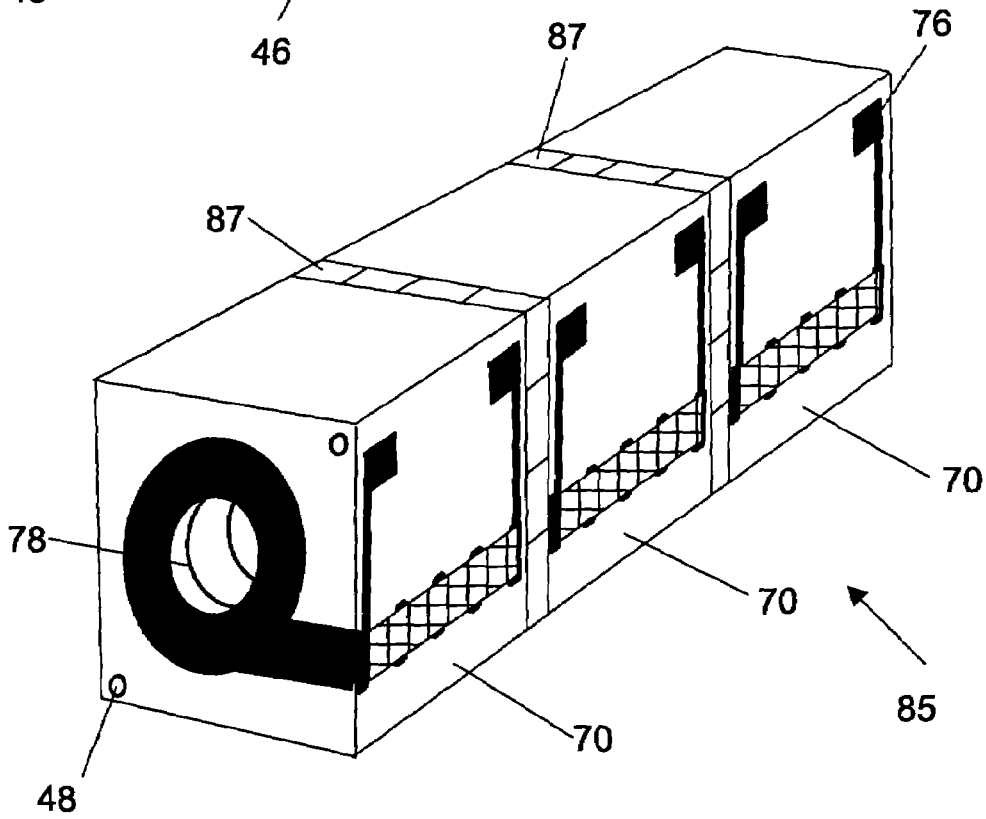
FIG. 11 shows a drift tube formed from bonding multiple sub-sections of FIG. 10.

As shown in FIG. 11, three sub-sections were bonded by fusible tape means into a tube (85) of approximately 1.20' extended length by using two layers of approximately 0.006' thick G-1005 fusible glass tape (87) disposed between three sub-sections (70). Bonding was achieved by heating a stacked assembly of sub-sections and fusible tape from room temperature, approximately 22° C. to 450° C. at a 10° C./minute thermal ramp rate and holding at 450° C. for about 30 minutes. The stacked assembly is then heated at about a 10° C./minute thermal ramp rate to about 590° C. and held at about 590° C. for about 10 minutes. The stacked assembly is then further heated at about a 1° C./minute thermal ramp rate to 670° C. and held at 670° C. for about 10 minutes and then allowed to cool back to room temperature at about 50° C./min. By this method, airtight bonds are be formed between sub-sections to form a tube of extended length (85), having parallel spaced conductor rings (78) on the inner diameter of the tube.

The bonded sections (85) form an essentially complete drift tube, that may be joined to an end cap structure to provide for carrier gas flow into the drift tube, a sample gas inlet structure and an exhaust port, and ionizing source, constructed by methods well known in the art. The bonded drift tube can be mechanically attached to these components by traditional adhesive, metallurgical methods or by another application of fusible glass tape. The conductor pattern on the exterior of the drift tube provides electrical connection points (76) for interfacing to the IMS control electronics.

Figure 12:
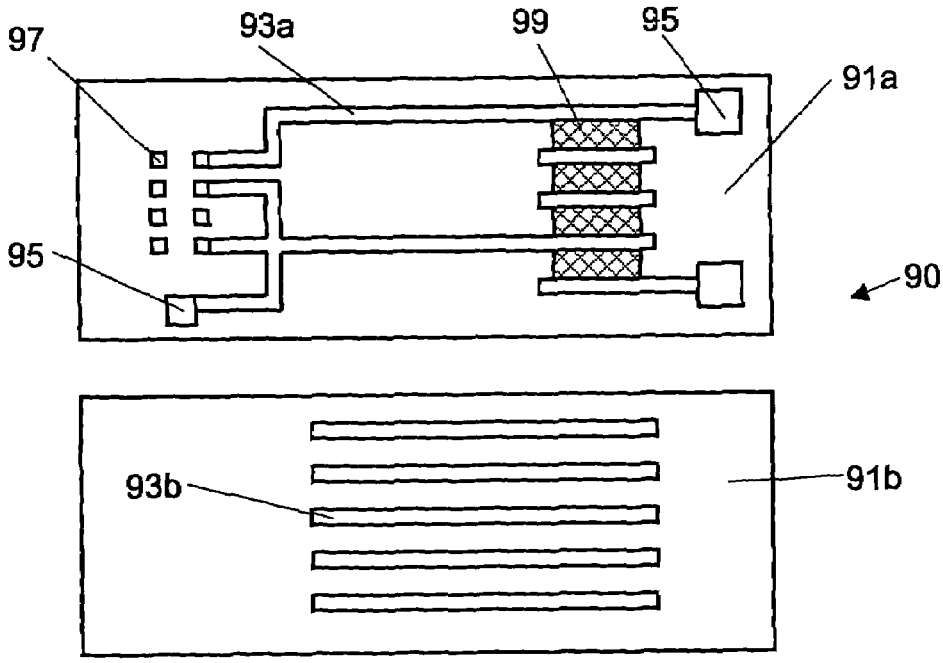
FIG. 12 shows opposed first and second surfaces of a green ceramic sheet with conductor and resistor patterns according to a third embodiment of the invention.

In another embodiment of the invention a tubular substrate is formed by lamination of two flexible green ceramic sheets, preferably comprising unfired LTCC, with a removable mandrel interposed between the two flexible sheets. As shown in FIG. 12, a first flexible green ceramic sheet (90) comprises one or more layers of LTCC and has a first surface (91*a*) with applied conductor pattern (93*a*), and opposed second surface (91*b*) with parallel spaced elongated conductors (93*b*). Conductors (93*a*) on the first surface of sheet (90) may additionally be provided with contact pads (95) for interfacing to IMS electronics or contact pads (97) for interfacing directly to electronic devices by surface mount soldering, wire bonding or other means as are well known in the art. A resistor pattern (99) may be applied in concert with conductor pattern (93*a*) to provide an eventual voltage divider network.

Figure 13:
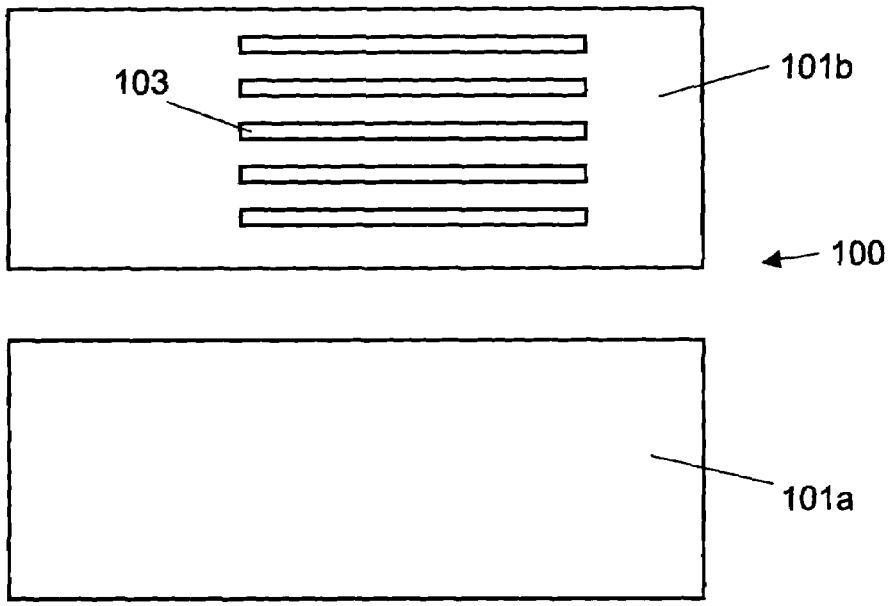
FIG. 13 shows opposed surfaces of a second ceramic sheet for use in the third embodiment.

As shown in FIG. 13, A second flexible sheet (100) is provided comprising one or more layers of green LTCC, having a first surface (101*a*) and a second surface (101*b*) having applied parallel spaced conductors (103). In the present embodiment, parallel spaced conductors (93*b*) and (103) will form parallel spaced concentric rings of conductors on the inner diameter of the eventual tube. Additional conductor and resistor patterns may be applied to second sheet (100), but they are not necessary for the functionality of the eventual drift tube. The width and spacing of the conductors (93*b*) and (103) is not critical to the invention, however it is preferred to have a plurality of finely spaced parallel concentric conductor rings on the inner diameter of the eventual tube to provide a more uniform electric field along it's length. In the present embodiment of the invention, these conductors are typically 0.020' wide screen printed gold lines on 0.030' centers.

Figure 14:
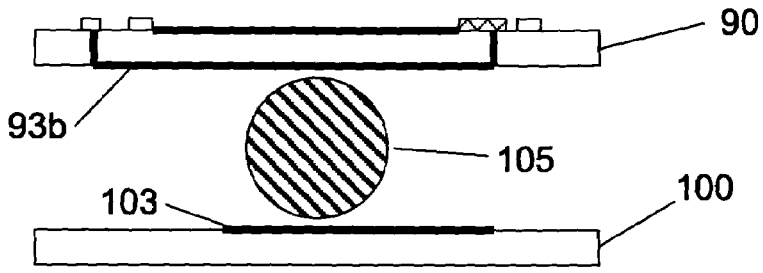
FIG. 14 shows the sheets of FIGS. 12 and 13 arranged with a mandrel.

FIG. 14 shows a cross-section of the first green ceramic sheet (90) positioned above second green ceramic sheet (100) with parallel spaced conductors (93*b*) on the second surface of the first flexible sheet facing and aligned with parallel conductors (103) on the second surface of the second flexible sheet (100). A cylindrical mandrel (105) interposed between first flexible sheet (90) and second flexible sheet (100) is used as a temporary form for producing a tube in the intervening region between the two sheets. In the present embodiment a mandrel with a round cross-section is used but similarly a mandrel with square, hexagonal or other cross sections could be used equally well.

The first and second flexible green ceramic sheets are restrained on the mandrel by means of vacuum bagging in a polymer film as is practiced in the art. Isostatic lamination conditions of about 3000 psi at about 68° C. and for about 15 minutes are applied to the restrained green ceramic sheets while on the mandrel, to conform the interior surfaces of the first and second green ceramic sheets to the mandrel and set the overlapping regions of the two sheets.

Figure 15:
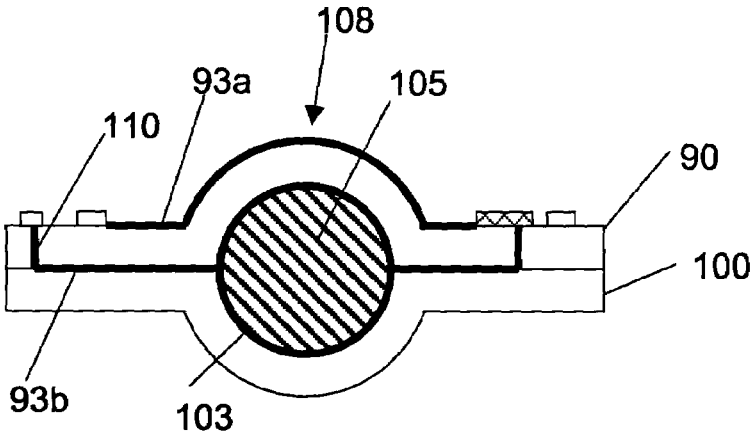
FIG. 15 shows the sheets of FIG. 14 after vacuum bagging and lamination, as formed over a mandrel.

FIG. 15 shows a cross-section of a first green ceramic sheet (90), a second green ceramic sheet (100) and the mandrel (105) in the laminated condition. Through alignment and lamination, conductors (93*b*) on first green sheet (90) are now in physical and electrical contact with conductors (103) on second green sheet (100) and form parallel spaced concentric rings of conductors around the inner diameter of the formed tube (108). Also shown in FIG. 15 are electrical vias (110) formed in the flexible green ceramic sheet by well known methods prior to lamination, that serve to electrically interconnect conductors (93*a*) on the first surface of sheet (90) to conductors (93*b*) on the opposed surface of sheet (90). It is preferred that the electrical vias are not located within the wall of the formed tube (108), but that vias be located in the overlapped portion of the two sheets. This is to prevent the possibility of leakage along vias, that could compromise the airtight quality of the tube. The mandrel is preferably removed from the laminated green ceramic sheets prior to the firing step, where the tubular substrate is stood on end in a conventional box or belt furnace. For a typical firing profile, tape is first brought from room temperature, approximately 22° C. to 450° C. at a 3° C./minute thermal ramp rate. It is held at 450° C. for about 2 hours and is then brought to 850° C. at a 2° C./minute ramp rate, and held at 850° C. for about 30 minutes.

Figure 16:
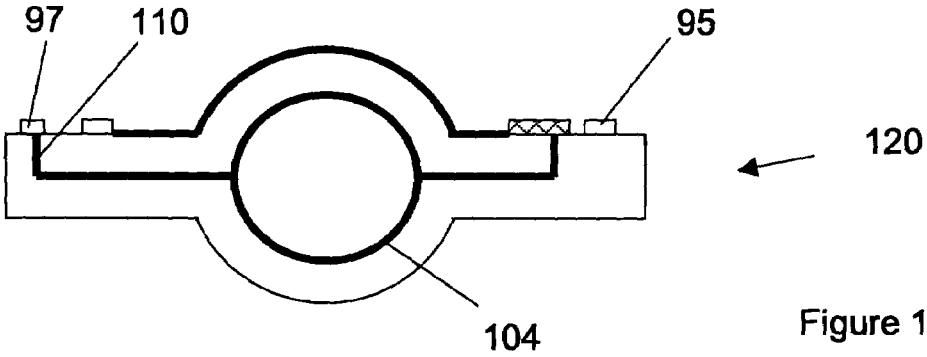
FIG. 16 shows the tube formed after firing the sheets of FIG. 16 with the mandrel removed.
Figure 17:
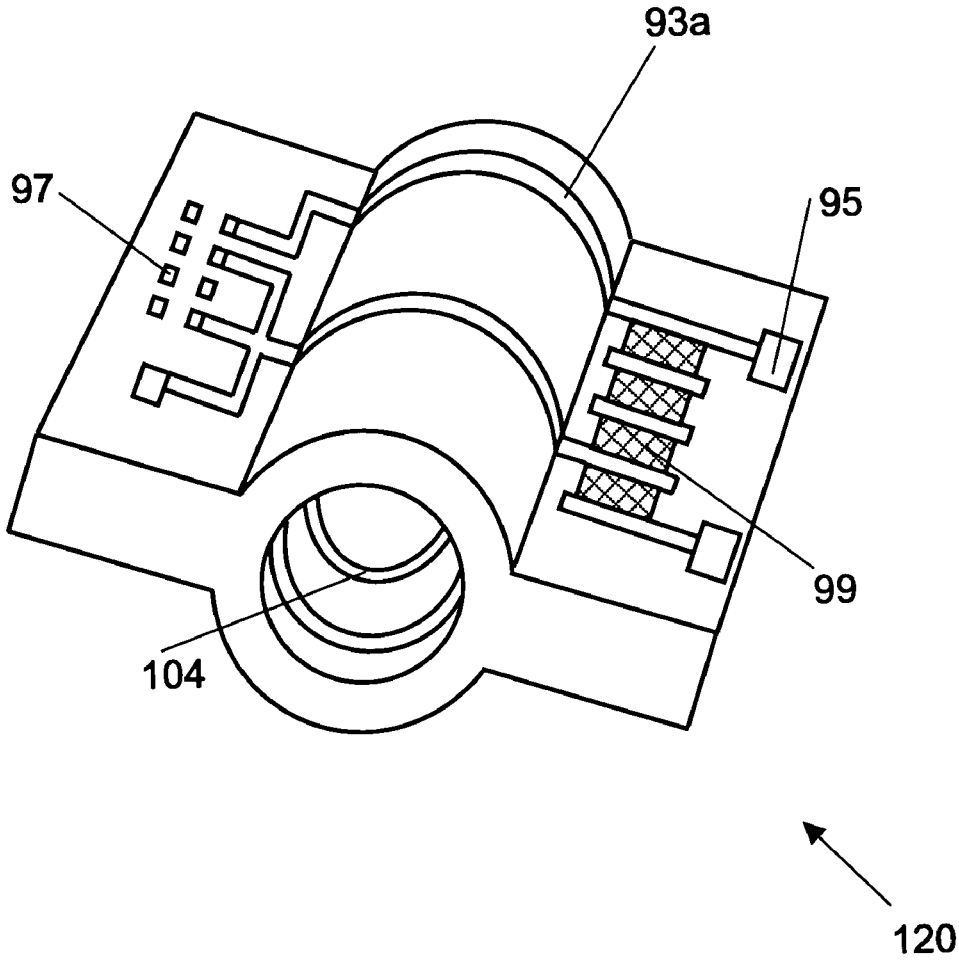
FIG. 17 shows a fired tubular substrate of the third embodiment.

FIG. 16 shows a cross-section of the fired tubular substrate (120), having parallel concentric conductor rings (104) on the inner diameter of the tube, formed by conductors (103) and (93*b*). Contact pads (95) are used to electrically interface the now essentially complete drift tube (120) with the electronics of an IMS. Additional contact pads (97) can be used for direct mounting of electronic devices (not shown) by soldering, wire bonding or other means as known in the art. This embodiment of the present invention is shown in FIG. 17 where a tubular substrate (120) has parallel spaced concentric conductive rings (104) provided on the inner diameter of the tube, external conductors (93*a*) with contact pads (95) for interfacing to IMS electronics and contact pads (97) for direct mounting of electronic components to the substrate (120). A resistor pattern (99) in concert with conductors (93*a*) provides a voltage divider network electrically connected to the interior parallel spaced concentric conductive rings (104), whereby an electrical field gradient can be established along the length of the tube as required of an IMS. The tubular substrate (120) provides an essentially complete drift tube, as may be joined to an end cap structure to provide for carrier gas flow into the drift tube, a sample gas inlet structure and an exhaust port, and ionizing source constructed by methods well known in the art. The drift tube can be mechanically attached to these components by traditional adhesive, metallurgical or other methods practiced in the art.

As shown in FIG. 17, the present embodiment comprises a tube extending across one dimension of substrate (120), however the exact shape and direction of the tube is determined by the shape and placement of mandrel (105) in FIGS. 14 and 15. The present invention comprises mandrels that can be formed into a variety shapes producing a tube with a bend or curve in the plane of the substrate formed. The mandrel for example could be formed of a 'sacrificial' organic material that would be burned off during the firing step. A "U" shaped tube could be formed in this manner within a fired substrate.

Flexible printed wiring boards are available commercially and are widely manufactured by bonding, with or without an adhesive layer, ductile copper foil to a variety of dielectric sheet materials such as polyimide (Kapton™), polyester terephthalate (Mylar), and polytetrafluoroethylene (Teflon™ or PTFE). Preferred are dielectric's derived from polyimide and polytetrafluoroethylene as they are well known for their chemical inertness and stability at elevated temperatures. Dielectric thicknesses typically range from about 0.0005' to 0.005' with bonded copper conductor foil thickness ranging from about 0.0002' to 0.020'. Adhesives are typically comprised of a wide range of materials including acrylics, epoxies, polyesters and phenolic butyrals and are known stable at temperatures of about 150° C. and can tolerate short term exposures to an elevated temperature of about 250° C. Conductors are formed from the bonded copper foil by photolithographic and etching techniques, or printed in conductive inks. Compatible polymeric resistor materials are commercially available to provide integrated resistor networks and multi-layer substrates can be formed by alternately bonding additional dielectric layers and conductor layers into a stacked arrangement. Electrical vias can also be provided to interconnect conductor patterns on differing layers in a multi-layer stack up.

Figure 18:
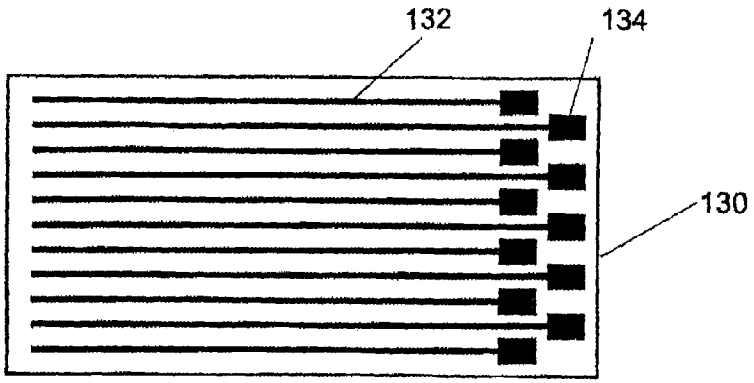
FIG. 18 shows a top view of a flexible printed wiring board substrate according to a fourth embodiment.

In another embodiment of the invention as shown in FIG. 18, a flexible printed wiring board substrate (130) has a plurality of parallel conductors (132) formed on a surface of the flexible substrate by photolithographic and etching methods. The flexible substrate (130) may be rolled into a tube wherein conductors (132) form parallel spaced concentric rings on the interior surface of the tube. In this embodiment the conductors were about 0.020' wide lines on about 0.030' spacings, having contact pads (134) for interfacing to external electronic circuitry. It is preferred that the conductor pattern comprise fine lines and narrow spacings to provide a plurality of finely spaced parallel concentric conductor rings along the length of the eventual tube, to allow establishing a more uniform potential gradient along the length of the tube. Current capabilities in the art allow these line widths and spacings to be reduced to on the order of 0.002'.

Figure 19:
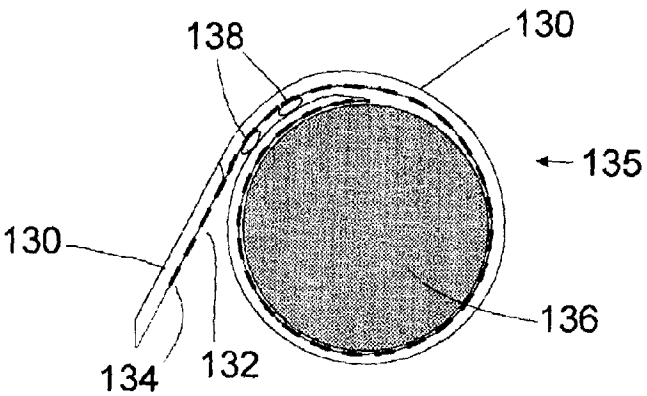
FIG. 19 shows the substrate of FIG. 18 rolled into the fourth embodiment.

FIG. 19 is a cross-section view of a flexible substrate (130) wrapped around a cylindrical mandrel (136) to form a tube (135). The rolled tube is sealed by adhesive applied as one or more strips (138) extending the length of the rolled tube. The adhesive strips form an air-tight seal along the length of the tube. It is preferred to use an adhesive such as an epoxy that is low in outgassing and possesses excellent resistance to degradation at elevated temperatures. After curing the adhesive, the mandrel (136) is removed from the rolled tube. Conductors (132) form spaced parallel concentric rings around the inner diameter of the tube that are electrically addressed through contact pads (134) which also provide an electrical interface to the electronics of an IMS. The flexible substrate with integral rolled tube (135) provides a now essentially complete drift tube, as may be joined to an end cap structure to provide for carrier gas flow into the drift tube, a sample gas inlet structure and an exhaust port, and ionizing source constructed by methods well known in the art. The drift tube can be mechanically attached to these components by traditional adhesive, metallurgical or other methods practiced in the art.

Additional objects, advantages, and novel features of the invention will become apparent to those skilled in the art upon examination of the following description or may be learned by practice of the invention. The objects and advantages of the invention may be realized and attained as particularly pointed out in the appended claims. It is intended that the scope of the invention be defined by the appended claims.

What is claimed is:

1. A method for producing a tube comprising:

rolling a green ceramic sheet around a form for more than one revolution, the green ceramic sheet having a first surface and an opposed second surface and at least one electrical conductor disposed on each of the first and second surfaces, the second surface facing the form, wherein said rolling causes at least one electrical conductor on the first surface to contact at least one electrical conductor on the opposed second surface;

restraining the rolled green ceramic sheet on the form;

applying a lamination pressure to set the green ceramic sheet on the form; and, firing the rolled green ceramic sheet.

2. The method of claim 1 wherein said restraining comprises wrapping the rolled green ceramic sheet on the form with a polymer film.

3. The method of claim 1, wherein the green ceramic sheet comprises LTCC tape.

4. The method of claim 3, wherein the green ceramic sheet has first and second edges perpendicular to the direction of rolling, and further comprising beveling at least one of the first and second edges.

5. The method of claim 1 wherein the first surface comprises an exterior surface of the tube and the second surface comprises an interior surface of the tube and, one or more electrical conductors disposed on the interior surface of the tube comprise one or more parallel spaced concentric rings.

6. The method of claim 1 wherein at least one electrical conductor disposed on at least one of the first surface and the opposed second surface, comprises one or more selected from the group consisting of a resistive element, and inductive element and a capacitive element.

7. A method for producing a tube comprising:

rolling a green ceramic sheet around a form for more than one revolution, the green ceramic sheet comprising LTCC tape, the green ceramic sheet having first and second edges perpendicular to the direction of rolling, at least one of the first and second edges being beveled, the green ceramic sheet having a first surface and an opposed second surface and at least one electrical conductor disposed on each of the first and second surfaces, the second surface facing the form, wherein said rolling causes at least one electrical conductor on the first surface to contact at least one electrical conductor on the opposed second surface;

restraining the rolled green ceramic sheet on the form;

applying a lamination pressure to set the green ceramic sheet to the form;

and, firing the rolled green ceramic sheet.

8. The method of claim 7, wherein the tube has an interior and an exterior surface, the electrical conductors on the second surface forming parallel spaced concentric rings on the interior surface, each ring being electrically connected to a corresponding contact for that ring on the exterior surface by electrical paths that extend along the surfaces of the rolled substrate.

9. The method of claim 8, further comprising interconnecting the parallel spaced concentric rings of electrical conductors with resistors connected across the contacts on the exterior surface.

10. A method for producing a tube comprising:

rolling a flexible polymeric sheet around a form for more than one revolution, the flexible polymeric sheet having a first surface and an opposed second surface and at least one electrical conductor disposed on each of the first and second surfaces, the second surface facing the form, wherein said rolling causes at least one electrical conductor on the first surface to contact at least one electrical conductor on the opposed second surface;

processing the rolled flexible polymeric sheet into a tube, wherein said processing comprises one or more actions selected from the group consisting of restraining, laminating, curing, and adhesively bonding.

11. The method of claim 10 wherein the first surface comprises an exterior surface of the tube and the second surface comprises an interior surface of the tube and, one or more electrical conductors on the interior surface of the tube comprise one or more parallel spaced concentric rings.

12. The method of claim 10 wherein at least one electrical conductor disposed on at least one of the first surface and the opposed second surface, comprises one or more selected from the group consisting of a resistive element, and inductive element and a capacitive element.

* * * * *